United States Patent [19]

Jacobson

[11] Patent Number: 5,031,516

[45] Date of Patent: Jul. 16, 1991

[54] NEGATIVE AIR CONTROL UNIT AND CLOSURE

[76] Inventor: Earl B. Jacobson, 510 S. Shore Dr., Crystal Lake, Ill. 60014

[21] Appl. No.: 447,918

[22] Filed: Dec. 8, 1989

Related U.S. Application Data

[63] Continuation-in-part of Ser. No. 277,772, Nov. 30, 1988.

[51] Int. Cl.[5] ..... E06B 7/02

[52] U.S. Cl. ..... 98/87; 98/1

[58] Field of Search ..... 98/1.5, 89, 87, 33.1, 98/1; 135/93, 95, 106

[56] References Cited

U.S. PATENT DOCUMENTS

| | | | |
|---|---|---|---|
| 1,856,658 | 5/1932 | Rummler | 135/93 |
| 3,282,274 | 11/1966 | Scott | 135/106 |
| 4,706,551 | 11/1987 | Schofield | 135/93 |
| 4,928,581 | 5/1990 | Jacobson | 98/1.5 |

*Primary Examiner*—Henry A. Bennett
*Assistant Examiner*—W. Doerrler
*Attorney, Agent, or Firm*—Leydig, Voit & Mayer

[57] ABSTRACT

A variable air flow orifice for variable air control structures including an adjustable flap panel formed over one opening in a wall or door of the negative air structure. The adjustable flap is formed in the panel and secured thereto by a zipper including one or a pair of zipper pulls. The opening also can be covered by a screen.

11 Claims, 4 Drawing Sheets

FIG. 1
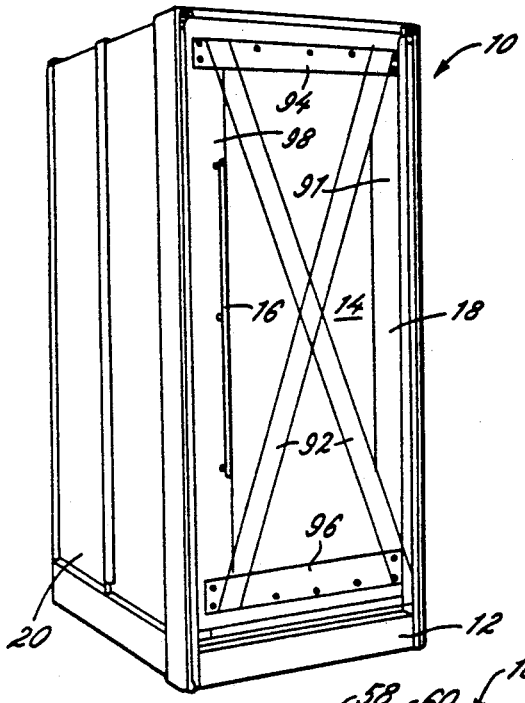
FIG. 2
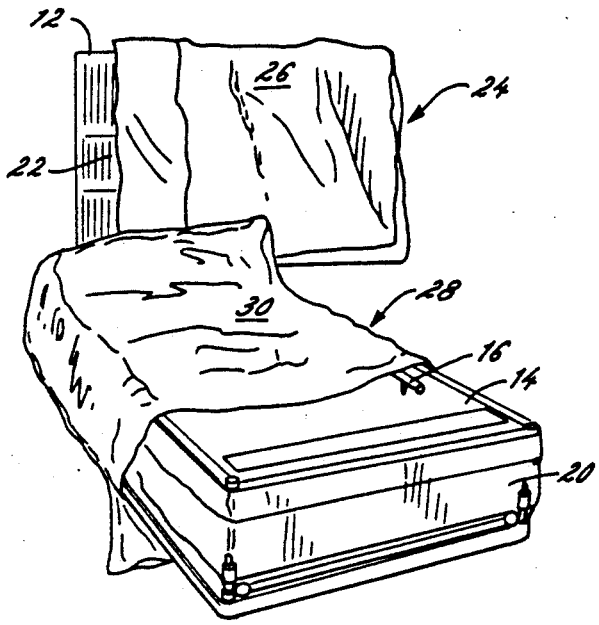
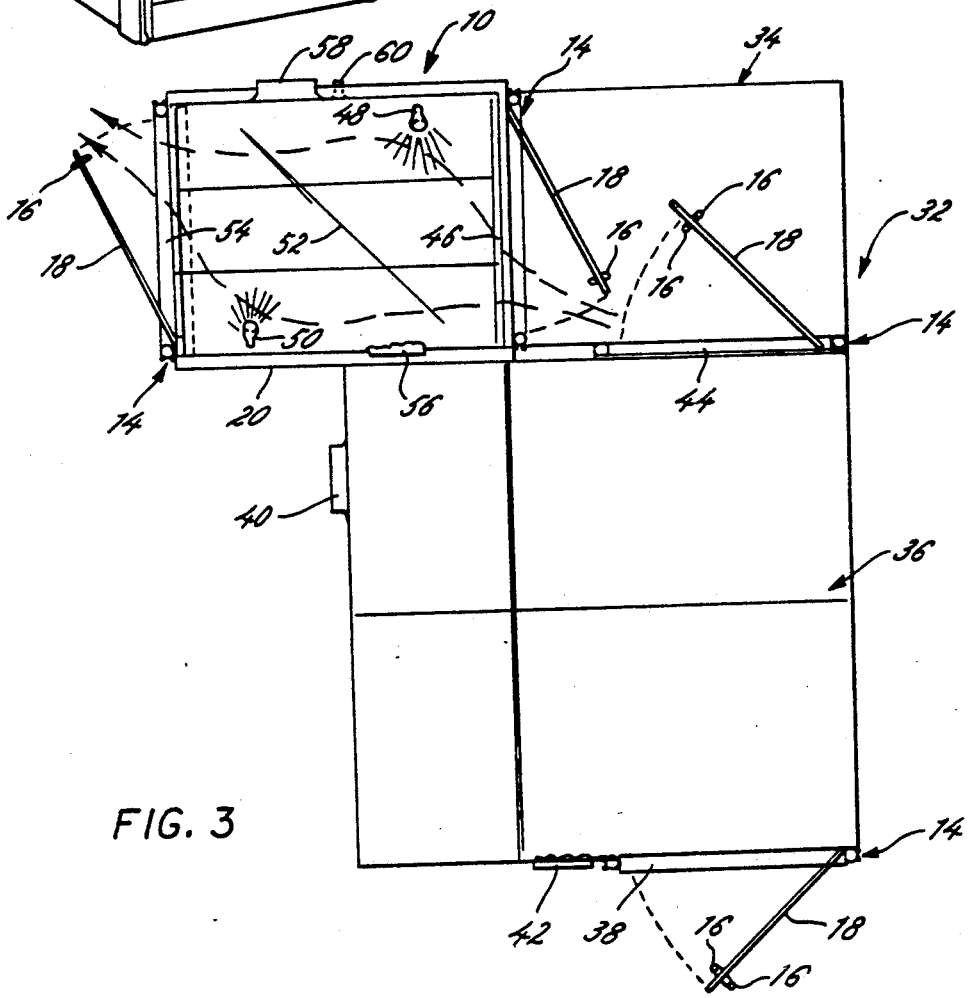
FIG. 3

FIG. 5
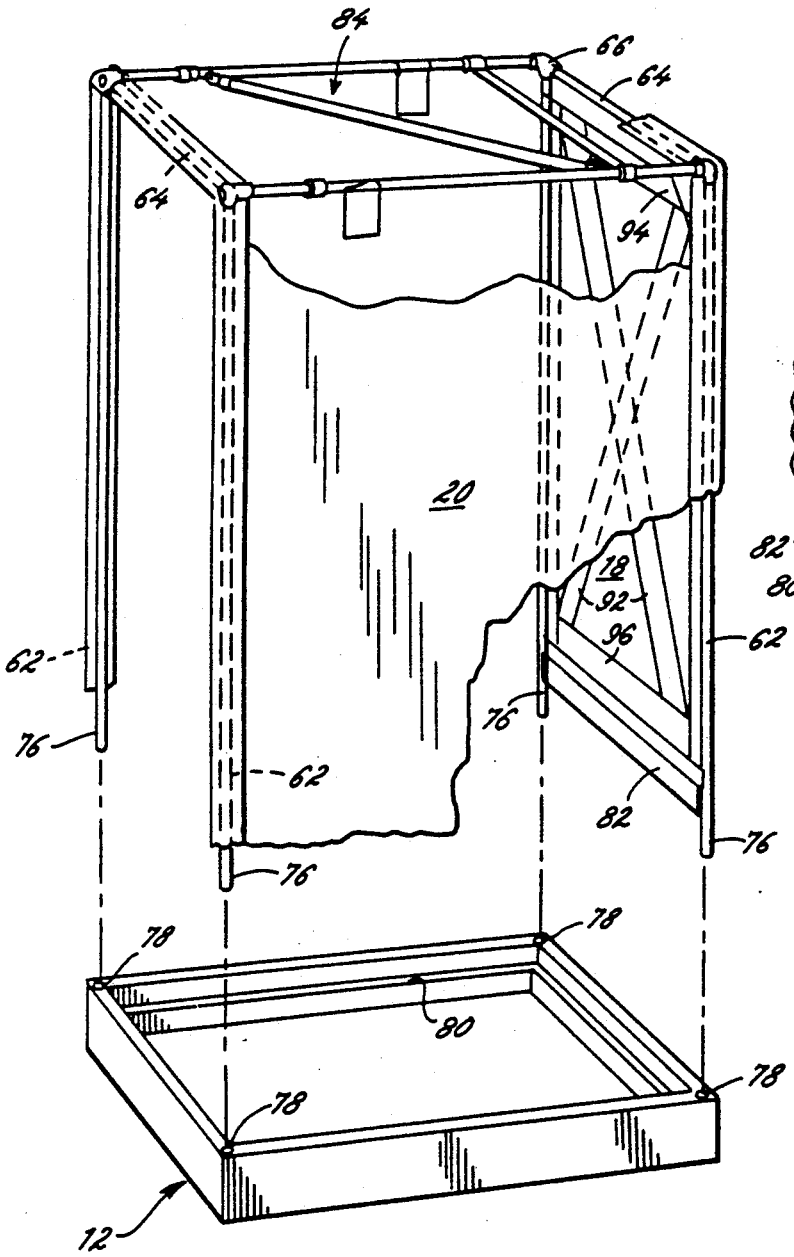
FIG. 6
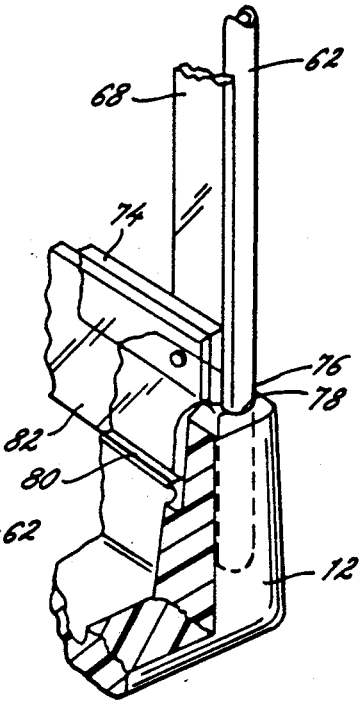
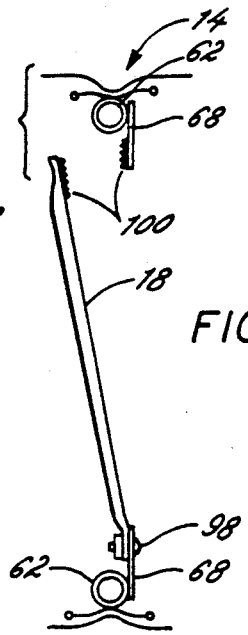
FIG. 7
FIG. 8
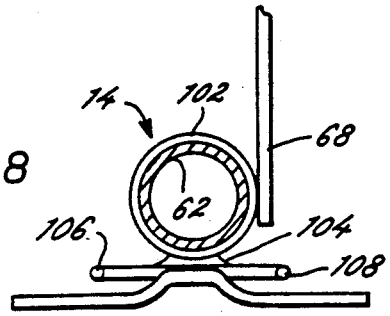

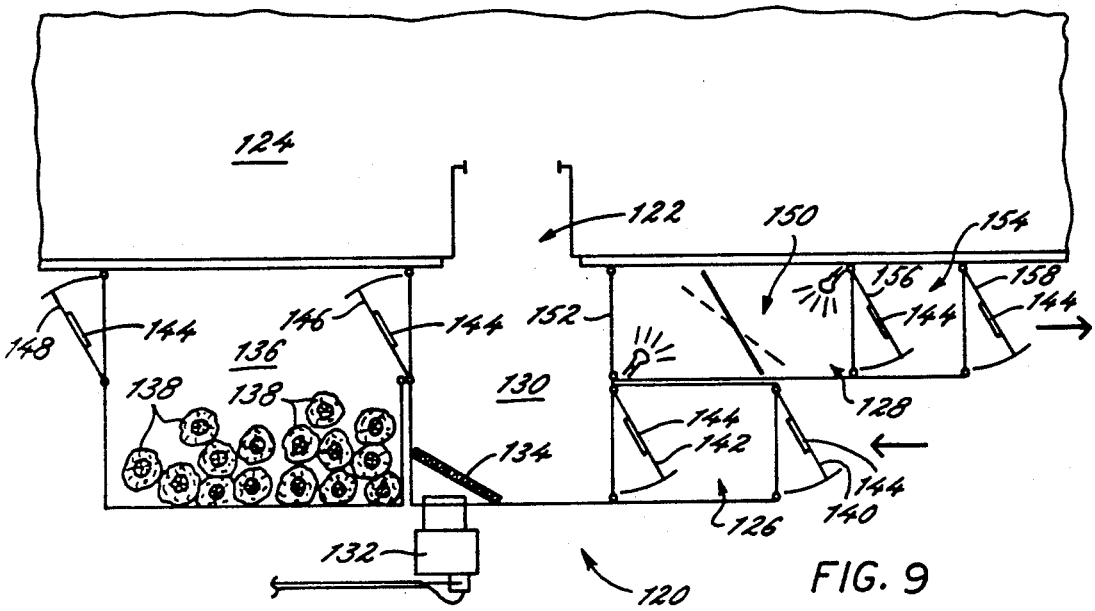
FIG. 9
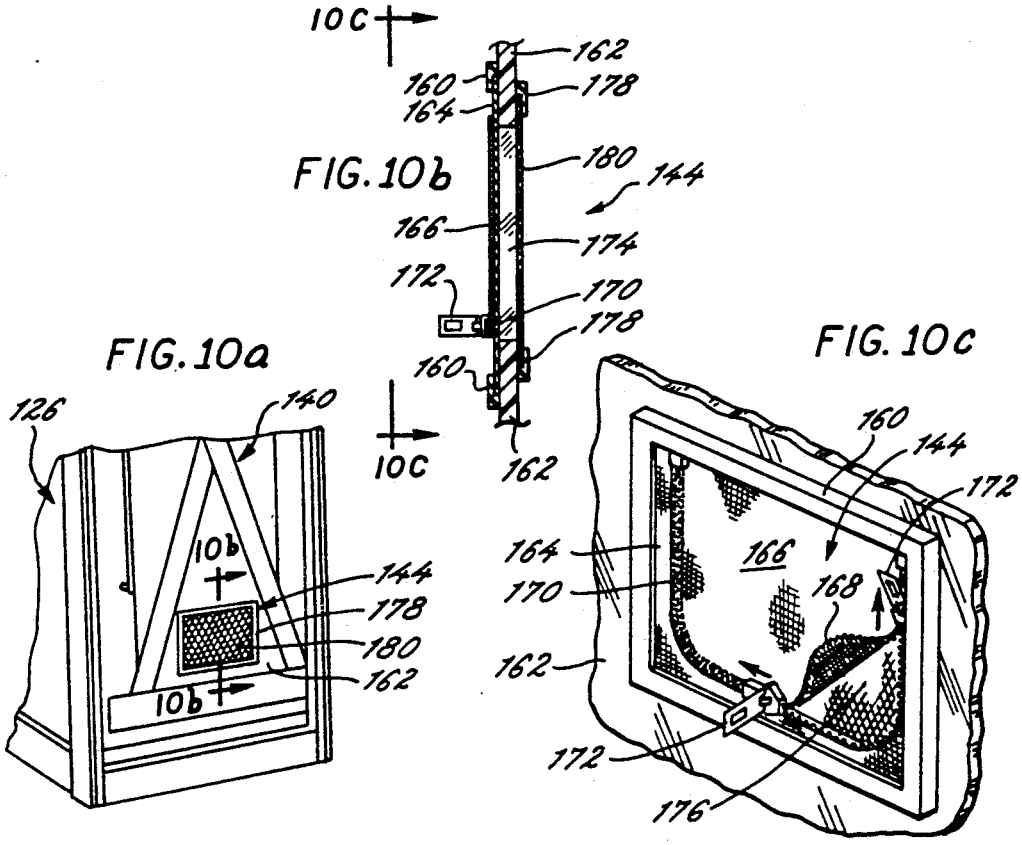

NEGATIVE AIR CONTROL UNIT AND CLOSURE

CROSS REFERENCE TO RELATED APPLICATION

This application is a continuation-in-part of U.S. Ser. No. 07/277,772, filed Nov. 30, 1988, now U.S. Pat. No. 4,927,581 the disclosure of which is incorporated by reference.

FIELD OF THE INVENTION

This application relates generally to hazardous waste removal systems and more particularly to a portable negative air control unit and closure structure having a variable orifice utilized to control airborne particulate contamination.

BACKGROUND OF THE INVENTION

The problems of asbestos fiber contamination and the removal of asbestos materials are well documented. Various types of containment structures have been utilized to control the airborne particulate matter such as asbestos fibers or other types of contaminants.

The prior structures generally are of two types. One time constructed, substantially permanent, type structures which generally are cumbersome and cannot be reutilized or portable structures which generally are not adapted to be utilized with negative air systems.

The prior portable structures generally are constructed from aluminum or rigid polyvinyl materials, which are not well suited for negative air utilization. Further, the closure structures of these portable structures, typically are formed by utilizing one or more flexible curtains. These curtains do not provide a suitable closure structure to maintain negative air control.

One improved portable negative air control unit is provided by parent application U.S. Ser. No. 07/277,772. The unit includes two or more door structures, which are substantially rigid and configured to maintain the negative air control. The door structures can be connected to the walls of various types of negative air structures.

One prior art system for controlling the negative air pressure in such structures provides for a free hanging flap or curtain. The flap is pulled open by the negative air flow and closes if negative air pressure is lost. To ensure no outward air leakage, the flap is configured larger than the opening to seal the opening shut. No variable adjustment is provided by the flap.

It would be desirable to provide an adjustable opening or orifice in negative air control structures to provide a variable air flow control for the structures.

OBJECTS AND SUMMARY OF THE INVENTION

It is, therefore, a primary object of the present invention to provide a negative air control structure having a variable air flow control.

Another object of the present invention is to provide a variable air flow orifice for negative air control structures.

A further object of the present invention is to provide an improved closure structure incorporating a variable air flow orifice to provide the variable air flow control.

In general, the present invention contemplates a negative air control structure having at least one air lock for entrance and exit therefrom and having at least one variable air flow orifice therein. The air lock preferably include a pair of door closure structures to maintain the desired negative air and each door will include a variable air flow orifice. The variable air flow orifice is formed by a U-shaped opening formed in the door, which opening is covered by a zippered panel, which can be opened a fixed but variable amount by one or a pair of zippers. A screen can be provided over the opening.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIGS. 1–8 describe the embodiments disclosed in parent application Serial No. 07/277,772

FIG. 1 is a perspective view of an assembled negative air control unit of the parent application;

FIG. 2 is a perspective view of the unit of FIG. 1 disassembled;

FIG. 3 is a top plan view of another embodiment illustrating the utilization of the air control unit and improved closure structures of the parent application;

FIGS. 4 and 5 are partial perspective views of portions of the unit of FIG. 1;

FIG. 6 is a partial perspective view illustrating the mounting of the unit elements;

FIG. 7 is a top plan view of the improved closure structure of the parent application;

FIG. 8 is an enlarged partial plan view of the structure of FIG. 7;

FIGS. 9 and 10 are directed to embodiments of the present invention;

FIG. 9 is a top plan view of one embodiment utilizing the variable air flow orifice of the present invention;

FIG. 10*a* is a partial perspective view of one embodiment of closure structure utilizing the variable air flow orifice of the present invention;

FIG. 10*b* is a side sectional view of the variable air flow orifice shown in and taken along the line 10*b* in FIG. 10*a*; and FIG. 10*c* is an enlarged perspective view of the variable air flow orifice shown in FIG. 10*a*.

Figure 4:
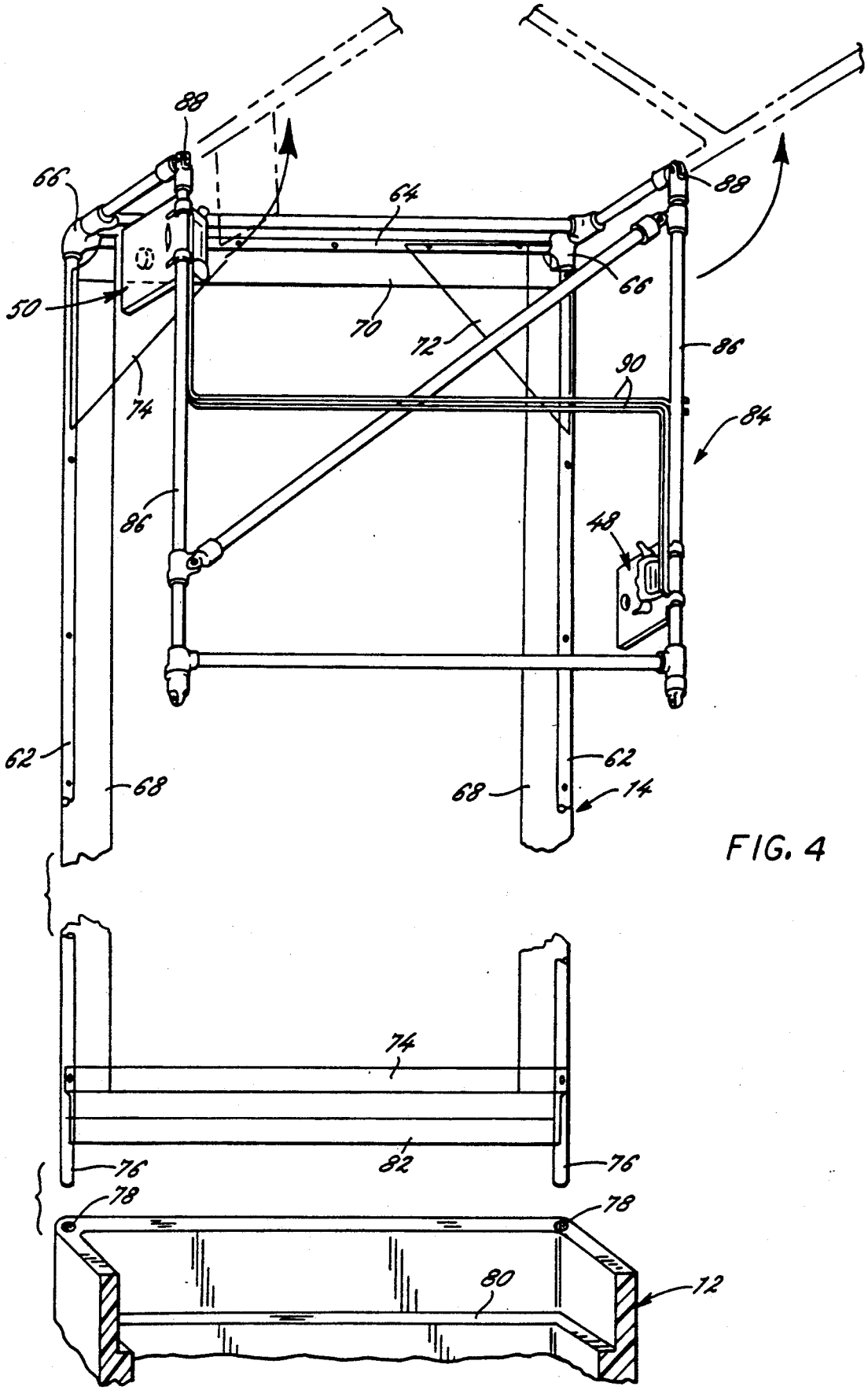

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DESCRIPTION OF THE PREFERRED EMBODIMENT

FIGS. 1–8 describe the embodiments of parent application, Ser. No. 07/277,772.

Referring to FIG. 1, a first embodiment of the assembled negative air control unit of the parent application is designated generally by the reference character 10. The unit 10 includes a base 12 which forms a containment pool when the unit 10 is utilized as a shower. The unit 10 includes at least one closure structure 14, which includes at least one handle 16 mounted to a hingedly mounted door panel 18. The hinged door panel 18 provides a number of advantages over the curtain of the prior art.

As will be described in detail hereinafter, the closure structure 14 mounts into the base 12 and includes a zipper around the periphery thereof to which connecting top and side walls, one of which 20 is illustrated, are attached. The walls are impervious and preferably are flexible and formed from vinyl or polyester coated rubber material, such as nylon reinforced tear resistant vinyl coated fabric. The fabric can be a loose weave polyester material, such as scrim. The base 12 preferably can be formed from fiberglass, but could be formed from other materials as desired.

The unit 10 is portable and can be collapsed for transportation and storage, as illustrated in FIG. 2. The base 12 will include a grating 22 when utilized as a shower/-water containment pool and forms one storage unit 24, which can be covered by a carrier pouch 26, which also can be formed from nylon reinforced vinyl material. The closure structure 14 and the walls 20 can be folded into a second compact storage unit 28, which also can be covered by a carrier pouch 30. The unit 28 also can be placed on edge and a carrier pouch (not illustrated) can be dropped over it, to avoid as much handling as possible.

The unit 10 can be assembled into any number of different configurations, for different uses, one of which is illustrated in FIG. 3. The unit 10 forms part of a three room module 32 which includes an optional air lock room 34 and a change room 36. Each of the rooms 34 and 36 will be formed similar to the unit 10 and will include the closure structures 14 as needed to provide the door panels 18 for entry and exit of the work site. The rooms 34 and 36 will not need containment pools and will only include removable floor panels as a base for the worker to walk on.

The change room 36 includes an outer doorway 38 which forms the exit and entrance to the module 32 from outside the work site. The negative air pressure ensures the sealing of the door 18, when it is closed in the doorway 38. The room 36 includes an outlet attachment 40, which is connected to a negative air machine or source to provide the negative air pressure in the room 36. This prevents contamination from exiting the room 36 through the outside doorway 38. The room 36 includes a make up air filter 42 which filters incoming air and is adjustable to maintain the desired negative air pressure in the room 36.

A connecting doorway 44 joins the change room 36 to the air lock 34. The air lock 34 operates in a conventional manner. The doorway 44 is normally closed, as is a second connecting doorway 46 which connects the air lock 34 to the shower unit 10. The worker opens the doorway 44 and enters the air lock 34 from the room 36. The doorway 44 then is closed, the negative air pressure aiding in sealing the door 18 shut. The worker then opens the doorway 46 and enters the shower unit 10. The air lock 34 also can include a filter like the filter 42 (not illustrated).

The shower unit 10 is illustrated with a pair of shower heads 48 and 50 and can include a divider curtain 52, so that two workers can shower at the same time. Normally the worker would not shower entering the work site (not illustrated) and would just pass through the shower through another doorway 54. The unit 10 also includes a make up air filter 56, which is utilized in the same manner as the filter 42. A source of negative air is attached to an outlet 58 to maintain the negative air pressure in the unit 10 to avoid contamination leakage.

The workers typically will shower when returning to the module 32 from the work site. The contaminated water retained in the base 12 of the unit 10, can be drained through an external drain connection 6 formed in the base 12.

Referring now to FIGS. 4–6, the assembly of the collapsible unit 10 is best illustrated. The closure structure 14 includes a pair of upstanding frame pipes or poles 62 forming the sides of the structure 14. A cross pipe 64 is mounted across the top ends of the pipes 62 by a pair of tee-type brackets 66. The pipes 62 and 64 are fabric covered (best illustrated in FIG. 8) and have polymer frame pieces, such as formed from a plastic-like material such as lexan, attached thereto by rivets or screws to complete the frame for the door 18. The particular number and size of the frame pieces is not critical and can be selected as desired to form a rigid, but lightweight door frame.

In the embodiment illustrated, the structure 14 includes a pair of rectangular frame pieces 68 attached to the pipes 62. The top pipe 64 includes a similar piece 70 secured thereto. For rigidity of the structure 14, a pair of corner pieces 72 each are attached to one of the pipes 62 and to the cross pipe 64 and the respective frame pieces 68 and 70. The bottom of the frame includes at least one crosspiece 74 which is attached to both the pipes 62 and both the pieces 68.

The bottom ends 76 of the pipes 62 preferably are left bare and are mountable into the base 12 into bores 78. The structure 14 then forms one side wall frame piece for the unit 10 or the other types of rooms 34 and 36. When the base 12 forms part of the shower unit 10, an internal ledge 80 is provided for the grating 27. Also, the bottom of the structure 14 preferably will include a splash guard 82 (best illustrated in FIG. 6) which is attached to the bottoms of the pipes 62 and can be attached to the crosspiece 74. The guard 82 is shaped to fit over and into the base 12 above the grate ledge 80. A curtain (not illustrated) also can be hung inside the structure 14 to further assist in preventing water from being splashed out of the unit 10.

Typically, although not illustrated in FIG. 5, the unit 10 or the rooms 34 and 36 will include a second closure structure 14 mounted into an adjacent wall of the base 12 (see room 34 in FIG. 3) or in the opposite wall of the base 12 (see unit 10 in FIG. 3). Once the other closure structure 14 or additional frame pipes 62 are inserted into the base 12, the rest of the frame and walls are added thereto.

In the shower embodiment, the unit 10 includes a foldable shower assembly 84. The assembly 84 includes one or more of the shower heads 48 and 50 mounted onto foldable cross pipes 86. The cross pipes 86 are foldable or hinged by socket swivels 88 to allow the assembly 84, illustrated in FIG. 4, to fold for storage as depicted in FIG. 2. The assembly 84 is erected by unfolding the pipes 86 and attaching them to the opposite wall or frame structure 14. The shower heads typically are connected to hot and cold water pipes 90 also mounted on the assembly 84, which are connected to a suitable source at the work site (not illustrated).

Once the side and top frame is assembled, as illustrated in FIG. 5, with the pipe ends 76 inserted into the base 12, then the walls 20 are attached thereto. This completes the assembly of the unit 10. The door panel 18 has not been described in detail and can be formed in any number of embodiments, as long as the unit 10 is substantially sealed to form the negative air structure. Although not illustrated, the door 18 also can include an adjustable flap which is partially opened or closed to provide the desired negative air control.

For example, one embodiment of the door panel 18 is illustrated in FIGS. 1, 5 and 7. The door 18 includes one or more handles 16 as previously described. The door 18 which has an outer fabric covering to sealingly cover the doorway, includes internal frame pieces to form the fabric support. The door 18 preferably includes a pair of cross bars 92, joined by a top and bottom kick plate 94 and 96, respectively. The door 18 also includes one or a pair of upright supports 98 affixed to the cross bars 92 and the kick plates 94 and 96. Preferably the material of the door 18 is sealed around the frame pieces, like an envelope. The door material extends beyond the frame pieces on the sides, top and bottom of the door 18 to provide a very positive seal against the door frame of the structure 14.

The mounting and sealing construction of the door 18 is best illustrated in FIG. 7. The closure structure 14, including the support pipes 62 and the frame pieces 68, have previously been described. The structure 14 is mounted such that the door 18 is opened against the negative air pressure, which ensures that the door 18 normally remains closed and sealed when the negative air is operative to prevent leakage. The door 18 is mounted along one edge to one of the frame pieces 68 by a plurality of fasteners 98. The fabric material of the door has sufficient flexibility to itself form the door hinge. To assist in maintaining the negative air closure, the door 18 preferably includes some type of additional seal, such as a magnetic strip mounted on the door and the other frame piece 68 (not illustrated) or a conventional loop and hook structure 100, as illustrated.

Referring to FIG. 8, the structure to enable the closure 14 to be secured to one or more rooms or units is best illustrated. The pipe 62 includes a fabric covering 102. The frame piece 68 is riveted or otherwise secured to the pipe 62 through the fabric 102 to provide an air flow seal between the pipe 62 and the frame piece 68. The fabric covering 102 also has sealingly attached a two-sided zipper assembly 104. The assembly 104 includes a pair of zipper structures 106 and 108, which mate with a zipper structure on the edge of the wall 20 (not illustrated). The zipper assembly 104 also includes an outer fabric flap 110 which seals either one or both zipper structures 106 and 108 from air flow leakage.

Referring to FIGS. 9 and 10, the embodiments of the present invention are illustrated.

A portable negative air structure 120 is formed at an entrance/exit 122 of a sealed containment area 124, (partially illustrated), which can be a building from which asbestos is to be removed. The negative air structure 120 includes at least one entrance module 126 and one exit and shower module 128. Alternatively, the shower module 128 can form both the entrance and exit of the negative air structure 120.

The negative air structure 120 includes a foyer area 130. The negative air flow is provided by a negative air or vacuum machine 132, which preferably is coupled through a larger area filter panel 134 to the foyer 130 and hence the area 124.

The negative air structure 120 also can include a bag storage and removal room 136. The asbestos contaminated and other disposable material is sealed into bags 138 for later removal.

In the removal operation, once the negative air structure 120 is in place, a worker enters the negative air structure 120 through the module 126. The module 126 is an air lock type structure having a pair of closure structures or doors 140, 142, such as the closure structure 14. The doors 140, 142 are operated in sequence, opening outwardly against the negative air flow and then being shut to maintain the integrity of the negative air structure 120. Each door 140, 142 includes a variable air flow orifice 144, which will be described in further detail with respect to FIGS. **10*a*–10*c***.

Once the worker is inside the foyer 130, the worker can pass into the area 124 and proceed with the asbestos removal. When the worker desires to remove the bagged material from the area 124, the worker places the bags 138 in the room 136 through a door 146. The door 146 again opens against the air flow and includes another variable air flow orifice 144.

When it is desired to remove the bags 138 from the room 136, a second outer door 148 is utilized, which also includes a variable air flow orifice 144. The room 136 and the doors 146, 148 also act as an air lock for the negative air structure 120.

When the worker desires to leave the area 124, the worker passes through the exit module 128. The module 128, includes a shower unit 150, such as the shower unit 10. The shower 150, can be a single or double shower unit and can include an entrance door or curtain 152, as desired. The worker exits from the shower 150 through an exit air lock module 154.

The exit module 154 is substantially identical to the entrance module 126 and includes a pair of doors 156, 158 each having a variable air flow orifice 144 therein. In operation, the openings of each of the variable air flow orifices 144 preferably is adjusted to the same size to provide uniform air flow as the workers pass in and out of the negative air structure 120.

Referring to FIGS. **10*a*–10*c*, one variable air flow orifice 144 is best illustrated. The variable air flow orifice 144 includes an inner frame 160, which can be secured to an impervious panel 162 formed in a wall or, as illustrated, the door 140 of the negative air structure 120. The frame 160 can be sewed or welded or otherwise secured to the panel 162. The frame 160 supports a panel 164**, which also can be formed of a flexible impervious material, such as a vinyl or polyester coated rubber material.

The panel 164 includes a central impervious panel or flap 166, which is secured around a periphery 168 to the panel 164 by a zipper 170. The zipper 170 includes one or a pair of zipper pulls 172. The panel 164 is secured over an opening 174 formed in the door or wall panel 162. By adjusting the zipper pull or pulls 172, a variable opening 176 is formed in the panel 164 to control the air flow or device. The panel 166 can be fully opened and secured away from the opening 176 if desired.

The variable air flow orifice 144, preferably includes an outer frame 178, also secured to the door panel 162 around the opening 174. The frame 178 secures a screen 180 over the opening 174. The screen 180 serves a dual purpose, preventing large air borne particulates from entering the negative air structure 120 and forming a stop for the flap 166 in the event of loss of negative air pressure, substantially preventing particulate air from flowing out of the negative air structure 120 through the opening 174.

Many modifications and variations of the present invention are possible in light of the above teachings. The structures can be formed in numerous sizes, shapes and configurations and the materials utilized can be varied as desired. For example, the flap 166 can be triangular and attached to the panel 164 along only a pair of edges thereof. Although the variable air flow orifice 144 is illustrated as formed from a pair of frames 160 and 174, the screen 180 also can be secured under the frame 160, forming a single unit on one side of the panel 162. It is, therefore, to be understood that within the scope of the appended claims, the invention may be practiced otherwise than as specifically described.

I claim as my invention:

1. A variable air flow opening module for utilization in one or more walls of a negative air control structure, said module comprising:

at least two walls secured to said negative air control structure to form an air lock type structure for entering or exiting said negative air control structure;

a panel secured over an opening in two of the module walls, each said wall being a portion of a door panel; and each said panel including a flap formed therein and secured along at least two free edges thereof by zipper means, said zipper means and said flap forming a variable air flow opening in said panel whose size is adjustable to vary the air flow and including a screen secured over said opening.

2. The module of claim 1 wherein said panel is secured over one side of said wall and including said screen secured over a second side of said wall.

3. The module of claim 1 wherein said flap is a U-shaped flap and said zipper means are secured around the periphery thereof.

4. The module of claim 1 wherein said zipper means include two separate zipper pull mechanisms.

5. An air lock type negative air control unit, comprising:

a base;

at least two closure structures mounted to said base, said structures including a structure door frame having an inner peripheral edge;

a door panel mounted to said frame, including a rectangular frame having an outer peripheral edge and a fabric covering sealingly secured to said rectangular frame and extending beyond said inner peripheral edge, to seal against said structure door frame;

an air flow panel secured over an opening in said door panel, said air flow panel including a flap formed therein and secured along at least two free edges thereby zipper means, said zipper means and said flap forming a variable air flow opening in said panel whose size is adjustable to vary the air flow; and a top and a pair of unit walls secured to and between said closure structures.

6. The unit of claim 5 wherein said panel is secured over one side of said door panel and including a screen secured over a second side of said door panel.

7. The unit of claim 5 including a screen secured over said opening.

8. The unit of claim 5 wherein said flap is a U-shaped flap and said zipper means are secured around the periphery thereof.

9. The unit of claim 5 wherein said zipper means include two separate zipper pull mechanisms.

10. The module of claim 1 wherein each panel variable air flow opening is adjusted to substantially the same size to provide substantially uniform air flow in said negative air control structure.

11. The unit of claim 5 wherein each panel variable air flow opening is adjusted to substantially the same size to provide substantially uniform air flow through said unit.

* * * * *